US011022140B2

(12) United States Patent
Jensen et al.

(10) Patent No.: US 11,022,140 B2
(45) Date of Patent: Jun. 1, 2021

(54) FAN BLADE WINGLET

(71) Applicant: Johnson Controls Technology Company, Auburn Hills, MI (US)

(72) Inventors: Jordan R. Jensen, Wichita, KS (US); Tyler P. McCune, El Dorado, KS (US); Drew H. Carlton, Wichita, KS (US); Bennie D. Hoyt, Benton, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 168 days.

(21) Appl. No.: 16/129,604

(22) Filed: Sep. 12, 2018

(65) Prior Publication Data

US 2020/0072236 A1 Mar. 5, 2020

Related U.S. Application Data

(60) Provisional application No. 62/726,878, filed on Sep. 4, 2018.

(51) Int. Cl.

| | |
|---|---|
| ***F04D 29/38*** | (2006.01) |
| ***F24F 7/06*** | (2006.01) |
| ***F04D 19/00*** | (2006.01) |

(52) U.S. Cl.

CPC ..... *F04D 29/388* (2013.01); *F04D 19/002* (2013.01); *F04D 29/384* (2013.01); *F24F 7/065* (2013.01)

(58) Field of Classification Search

CPC ..... F24F 7/065; F04D 29/384; F04D 29/386; F04D 29/388; F04D 25/088

See application file for complete search history.

(56) References Cited

U.S. PATENT DOCUMENTS 871,729 A * 11/1907 McChord, Jr. ..... B64C 11/065 416/207
1,041,913 A * 10/1912 Tyson ..... F04D 29/384 416/236 R
1,055,947 A * 3/1913 Schwartzberg ..... F04D 25/088 416/62
2,711,087 A * 6/1955 Jennings ..... F24F 1/02 62/427
3,171,495 A * 3/1965 Puckett ..... B64C 11/16 416/228
4,128,363 A * 12/1978 Fujikake ..... F01D 5/145 416/175
4,189,281 A * 2/1980 Katagiri ..... F04D 29/547 123/41.49

(Continued)

FOREIGN PATENT DOCUMENTS

KR 1720644 B1 3/2017

*Primary Examiner* — Woody A Lee, Jr.
*Assistant Examiner* — Wesley Le Fisher
(74) *Attorney, Agent, or Firm* — Fletcher Yoder, P.C.

(57) ABSTRACT

The present disclosure relates to a flow generating device for a heating, ventilation, and/or air conditioning system. The flow generating device includes a housing having a channel defining a flow path of a fluid and a fan blade having a rotational axis extending through the channel, where the fan blade is configured to rotate to force the fluid along the flow path. A portion of the fan blade axially protrudes beyond the channel in a direction generally aligned with the flow path and a winglet extends from the portion of the fan blade.

22 Claims, 9 Drawing Sheets

(56) References Cited

U.S. PATENT DOCUMENTS

| | | | | |
|---|---|---|---|---|
| 4,222,710 | A * | 9/1980 | Katagiri | F04D 29/38 123/41.49 |
| 4,265,596 | A * | 5/1981 | Katagiri | F04D 29/384 416/175 |
| 4,662,823 | A * | 5/1987 | Cooke | F04D 29/36 416/228 |
| 5,181,830 | A * | 1/1993 | Chou | F04D 29/384 416/223 R |
| 5,215,441 | A | 6/1993 | Evans et al. | |
| 5,226,783 | A * | 7/1993 | Mita | F04D 29/384 416/223 R |
| 6,994,523 | B2 * | 2/2006 | Eguchi | F04D 29/384 416/228 |
| 7,934,907 | B2 | 5/2011 | Aynsley et al. | |
| 8,568,095 | B2 | 10/2013 | Bushnell | |
| 2003/0024264 | A1 * | 2/2003 | Jung | F04D 29/384 62/426 |
| 2011/0017427 | A1 * | 1/2011 | Kato | F24F 1/38 165/59 |
| 2011/0081246 | A1 * | 4/2011 | Aynsley | F04D 29/388 416/204 R |
| 2012/0108161 | A1 * | 5/2012 | Choi | F04D 29/164 454/341 |
| 2015/0354598 | A1 | 12/2015 | Dygert et al. | |
| 2016/0138601 | A1 * | 5/2016 | Gallina | F04D 29/384 416/223 R |
| 2018/0030996 | A1 * | 2/2018 | Schilling | F04D 29/388 |
| 2019/0078585 | A1 * | 3/2019 | Wei | F04D 29/384 |

* cited by examiner

FAN BLADE WINGLET

CROSS-REFERENCE TO RELATED APPLICATIONS

This application claims priority from and the benefit of U.S. Provisional Application Ser. No. 62/726,878, entitled "FAN BLADE WINGLET", filed Sep. 4, 2018, which is herein incorporated by reference in its entirety for all purposes.

BACKGROUND

This disclosure relates generally to heating, ventilation, and/or air conditioning (HVAC) systems. Specifically, the present disclosure relates to a fan blade winglet for a fan.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A heating, ventilation, and/or air conditioning (HVAC) system may be used to thermally regulate an environment, such as a building, home, or other structure. The HVAC system generally includes a vapor compression system, which includes heat exchangers such as a condenser and an evaporator, which cooperate to transfer thermal energy between the HVAC system and the environment. In many cases, a fan, such as an axial fan, is configured to direct an air flow across a heat exchanger. For example, the fan typically includes a motor configured to rotate a fan hub about a central axis of the fan. A plurality of angled fan blades extend radially from the fan hub, such that rotation of the fan blades generates an air flow from an upstream end portion of the fan to a downstream end portion of the fan. Unfortunately, conventional fan blades may incur relatively significant aerodynamic drag during operation, which may increase a power consumption of the fan motor, and thus, reduce an operational efficiency of the HVAC system.

SUMMARY

The present disclosure relates to a flow generating device for a heating, ventilation, and/or air conditioning system. The flow generating device includes a housing having a channel defining a flow path of a fluid and a fan blade having a rotational axis extending through the channel, where the fan blade is configured to rotate to force the fluid along the flow path. A portion of the fan blade axially protrudes beyond the channel in a direction generally aligned with the flow path and a winglet extends from the portion of the fan blade.

The present disclosure also relates to a flow generating device for a heating, ventilation, and/or air conditioning system, where the flow generating device includes a housing having a channel defining a flow path of a fluid. The flow generating device also includes a plurality of fan blades disposed partially within the channel, where the plurality of fan blades is configured to rotate about an axis within the channel and direct the fluid along the flow path. The flow generating device further includes a winglet coupled to a portion of a fan blade of the plurality of fan blades, where the portion of the fan blade axially protrudes beyond the channel.

The present disclosure also relates to a flow generating device for a heating, ventilation, and/or air conditioning system, where the flow generating device includes a housing having a channel defining a flow path for a fluid flow. An end portion of the channel is configured to receive the fluid flow from an ambient environment. The flow generating device also includes a fan blade disposed partially within the channel and configured to rotate about an axis within the channel, where rotation of the fan blade facilitates the fluid flow through the channel from the ambient environment. A portion of the fan blade axially protrudes beyond the end portion of the channel and a winglet brackets the portion of the fan blade.

BRIEF DESCRIPTION OF THE DRAWINGS

Various aspects of this disclosure may be better understood upon reading the following detailed description and upon reference to the drawings in which.

DETAILED DESCRIPTION

Figure 1:
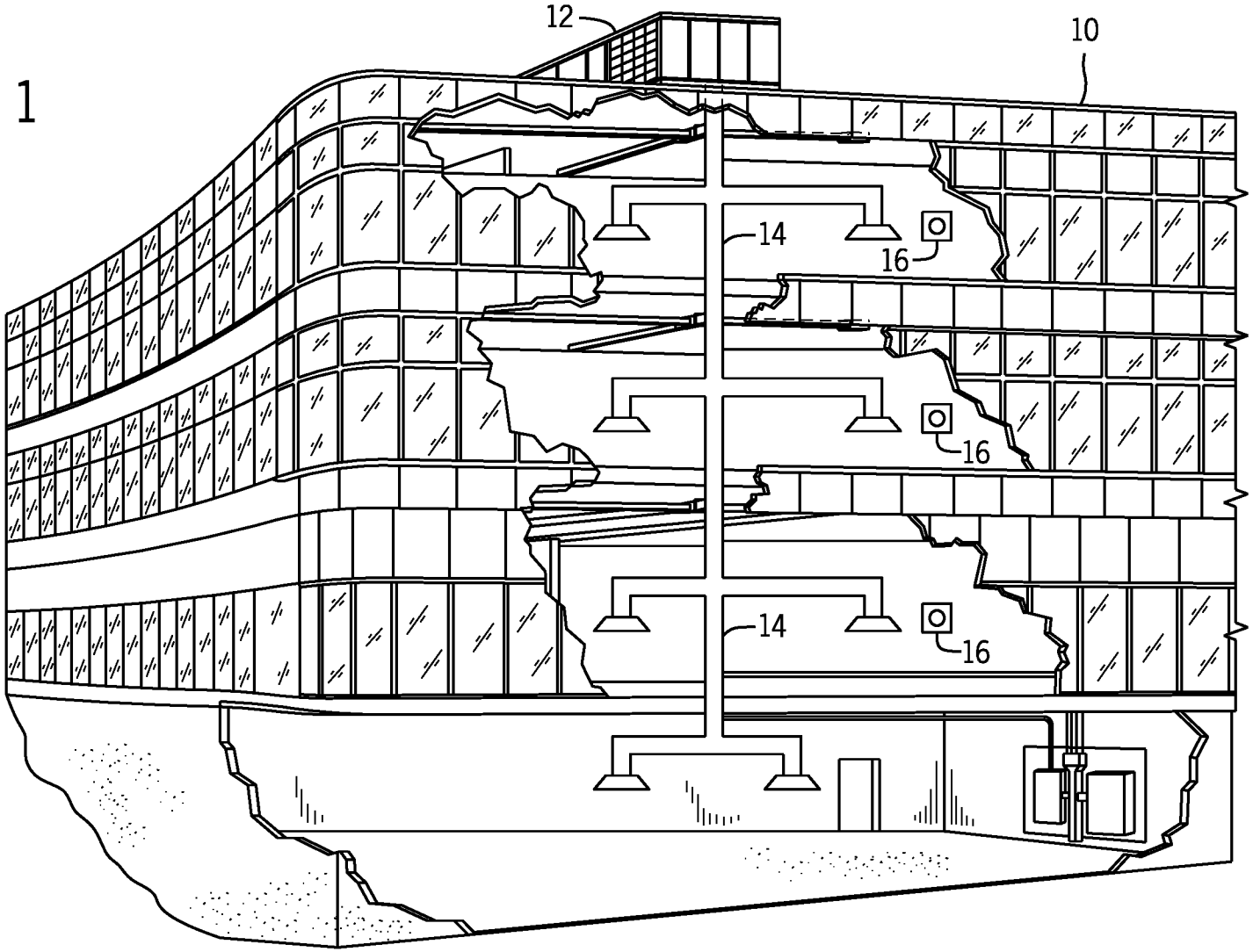
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As mentioned above, a heating, ventilation, and/or air conditioning (HVAC) system may include one or more fans that are configured to direct a flow of air across certain components of the HVAC system, such as a condenser and/or an evaporator. Typical fans include an actuator, such as an electric motor, which is configured to rotate a central fan hub about a central axis of the fan. A plurality of fan blades extend radially from the fan hub, relative to the central axis, such that rotation of the fan hub drives rotation of the fan blades. The fan hub and the fan blades collectively form a fan assembly, which may be partially disposed within a channel, or a venturi, defined by a fan housing. Accordingly, a portion of the fan blades may protrude axially from the channel, which will be referred to herein as an exposed portion of the fan blades. The fan blades each include an angled blade member having a pressure surface, or a first surface, and a suction surface, or a second surface, which is disposed opposite the first surface. Rotation of the fan assembly enables the pressure surface of the fan blades to engage with ambient air surrounding the fan assembly to generate an air flow through the channel from an upstream end portion of the channel to a downstream end portion of the channel. In some embodiments, the fan may include an axial fan, which directs the air flow in a direction generally parallel to the central axis of the fan. The fan assembly may thus generate a pressure differential between the upstream and downstream end portions of the channel. Unfortunately, conventional fan blades may enable a backflow of air to occur around a radial edge of the fan blades and, in particular, around a radial edge of the exposed portion of the fan blades from a high pressure region near the pressure surface of the fan blades to a low pressure region near the suction surface of the fan blades. This backflow of air may generate vortices near the radial edges of the fan blades, which may increase a velocity of the air flow near the suction surface of the fan blades and, as such, decrease a pressure of the low pressure region near the suction surface. Accordingly, such vortices generate an induced drag on the fan blades during operation of the fan, which may increase a power consumption of the actuator, and thus, reduce an operational efficiency of the fan. Unfortunately, typical fan blades may be ill-equipped to block an undesirable backflow of air around respective radial edges of the fan blades.

It is presently recognized that it may be desirable to block the backflow of air around the radial edges of the fan blades during operation of the fan. Specifically, it may be desirable to block air flow from the high pressure region to the low pressure region to reduce induced drag on the fan blades, and thus, increase an efficiency of the fan.

With the foregoing in mind, embodiments of the present disclosure are directed toward a fan blade winglet that is configured to substantially block air flowing around the exposed portion of the fan blades from the pressure surface to the suction surface. As described in greater detail herein, the winglet may couple to a radial edge of a respective fan blade and extend generally outward from the pressure surface. A lower edge of the winglet mates with an angled profile or curvature of the fan blade, and thus, blocks air flow around the radial edge of the fan blade to reduce or substantially eliminate the generation of vortices near the radial edge. In some embodiments, the winglet mates with a portion of the radial edge corresponding to the exposed portion of the fan blades. A profile of the winglet may be selected based on a geometric shape of the fan blades, as well as a position of the fan blades relative to a housing of the fan. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
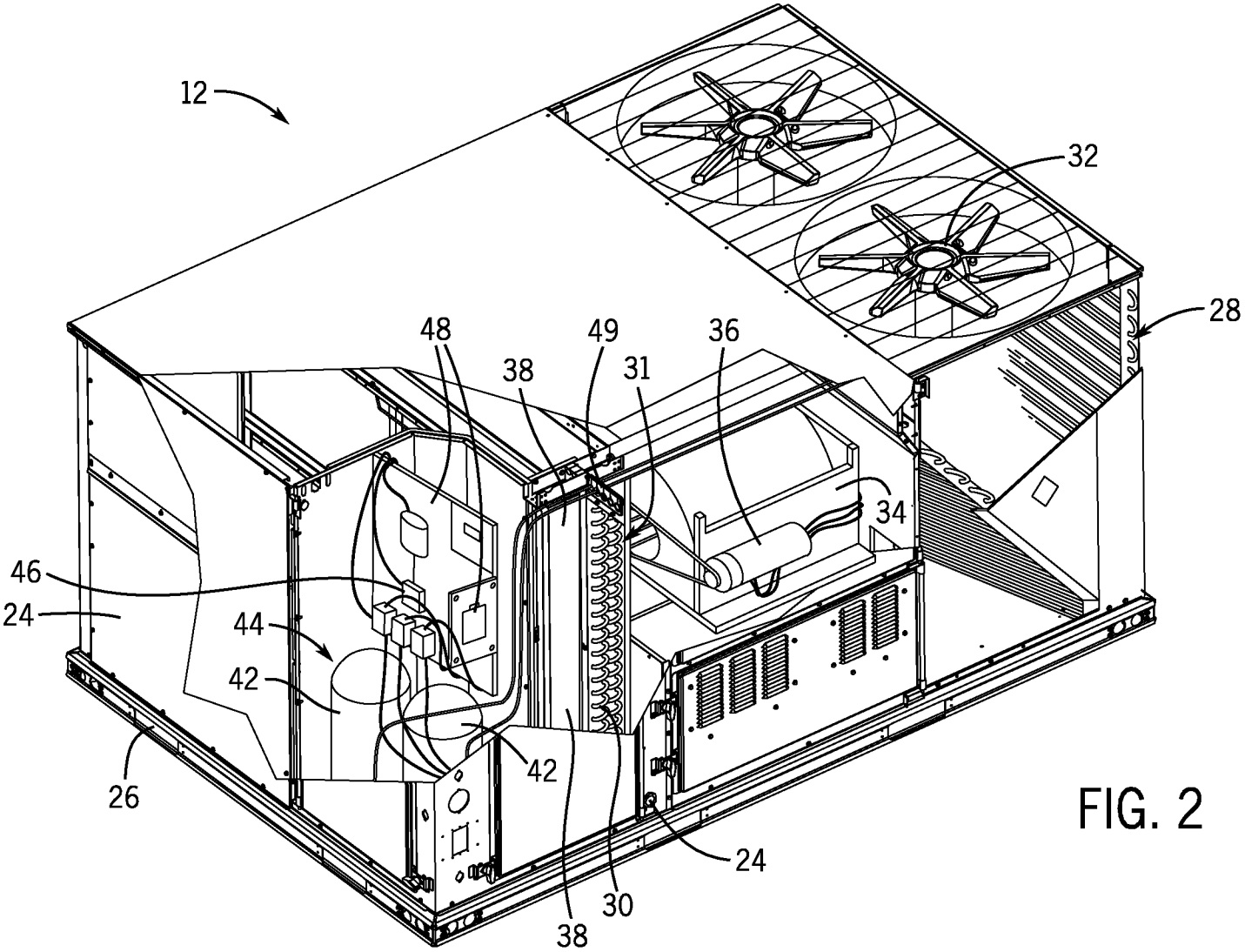
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
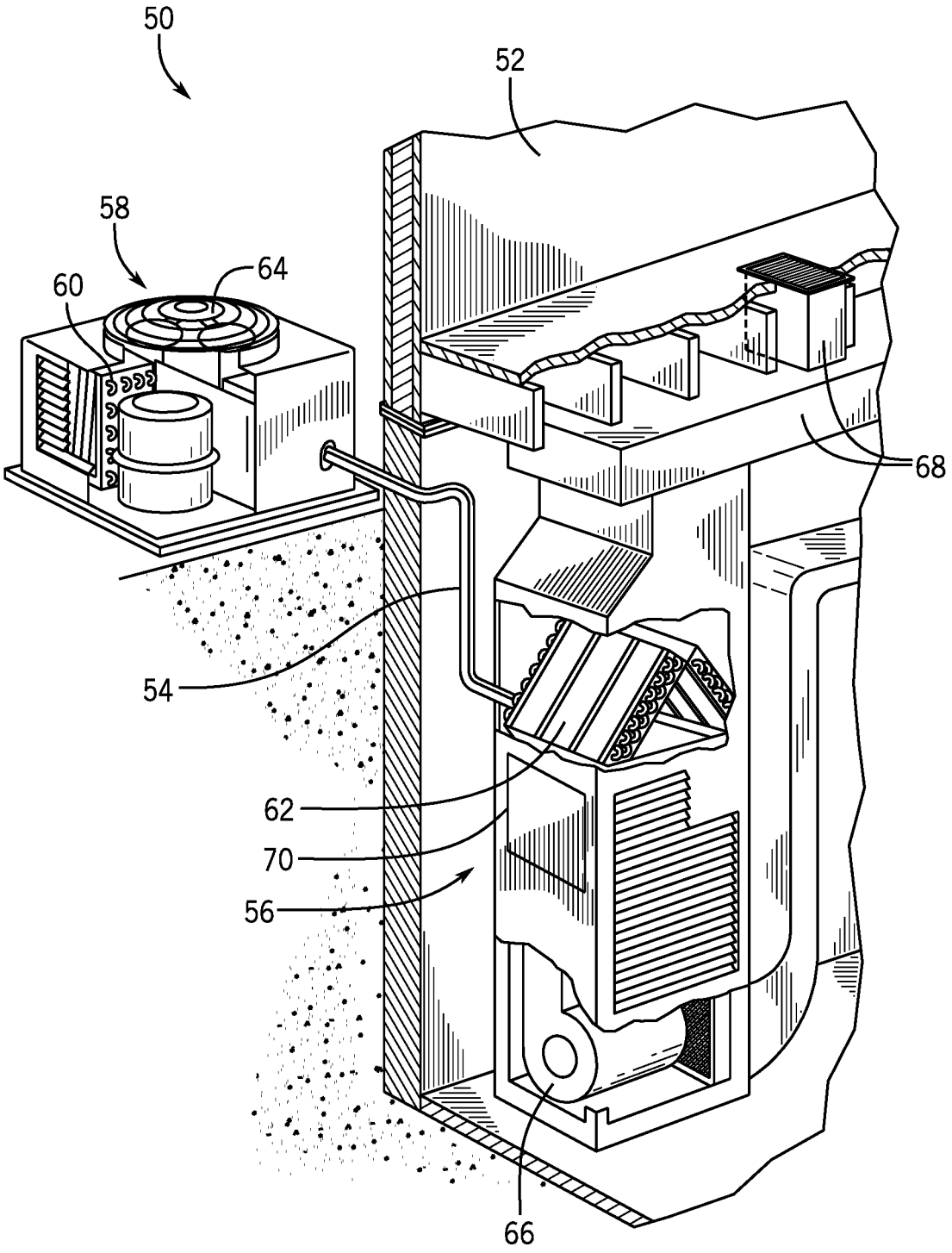
FIG. 3 is a perspective view of an embodiment of a residential split HVAC system, in accordance with an aspect of the present disclosure.

FIG. 3 illustrates a residential heating and cooling system, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
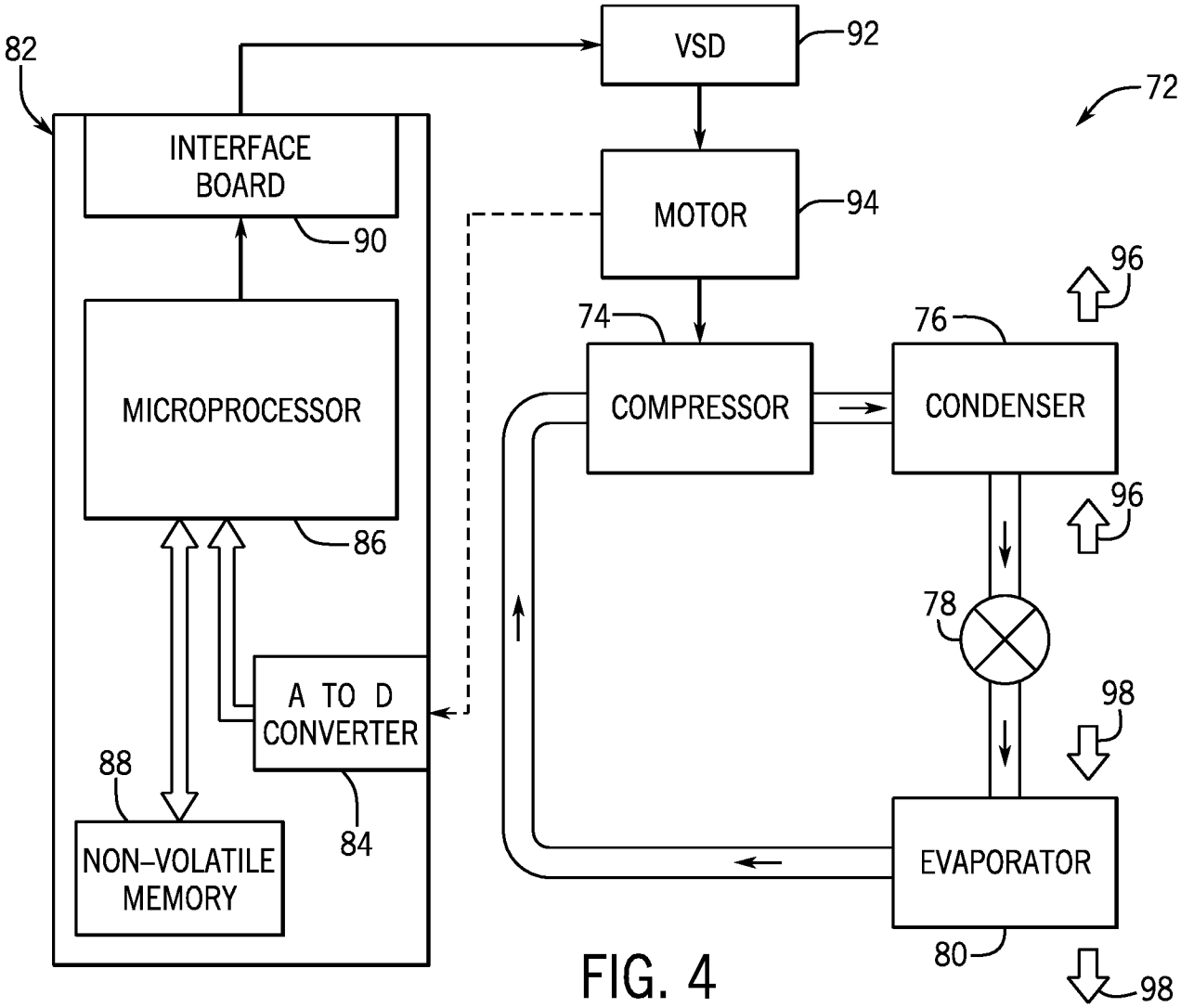
FIG. 4 is a schematic diagram of an embodiment of a vapor compression system that may be used in the packaged HVAC unit of FIG. 2 and the residential HVAC system of FIG. 3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or any other suitable HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
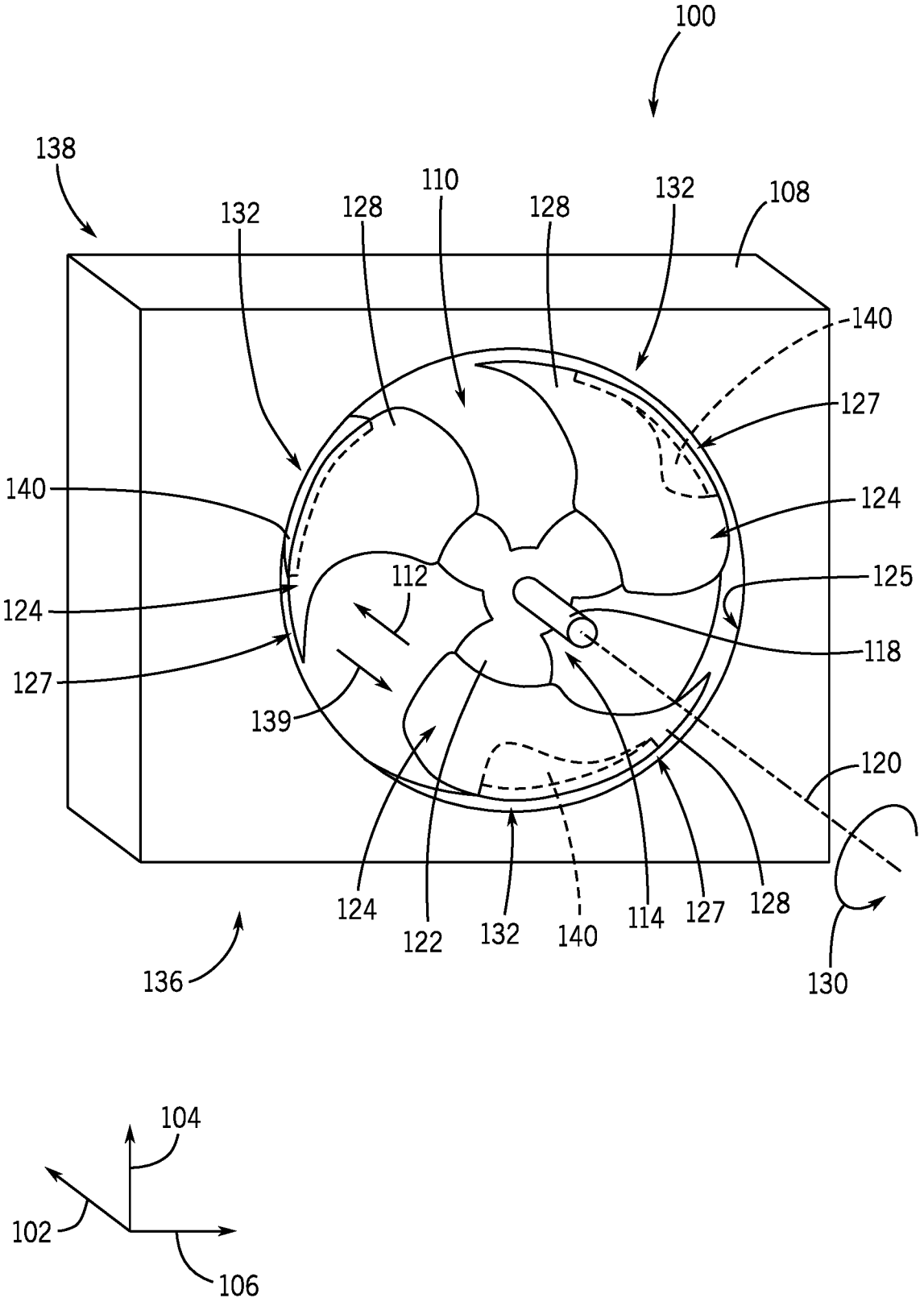
FIG. 5 is a perspective view of an embodiment of a flow generating device that may be used in an HVAC system, in accordance with an aspect of the present disclosure.

With the foregoing in mind, FIG. 5 is a perspective view of an embodiment of a flow generating device 100, such as an axial fan, which may be used in the HVAC unit 12, the residential heating and cooling system 50, or any other suitable HVAC system. For example, in some embodiments, the flow generating device 100 discussed herein may include the fan 32 of the HVAC unit 12 or the fan 64 of the outdoor unit 58. To facilitate discussion, the flow generating device 100 and its components will be described with reference to a longitudinal axis or direction 102, a vertical axis or direction 104, and a lateral axis or direction 106. The flow generating device 100 includes a housing 108, or a fan shroud, which includes a channel 110, or a venturi, defined therein. The channel 110 defines a flow path 112 for a fluid, such as air, which may flow through the housing 108 via the channel 110. A fan assembly 114 is disposed within a portion of the channel 110, or all of the channel 110, and is configured to facilitate directing the air along the flow path 112.

The fan assembly 114 includes a central shaft 118 that is positioned along the longitudinal axis 102 and is configured to rotate about an axis or centerline 120 of the channel 110 and/or the central shaft 118. The central shaft 118 is coupled to an actuator that is configured to drive rotation of the central shaft 118 about the centerline 120. For example, the actuator may include an electric motor, a hydraulic motor, a servo motor, or any other suitable actuator that may be used to rotate the central shaft 118 about the centerline 120. The actuator may be coupled to the housing 108 via mounting brackets that substantially restrict movement of the actuator and/or the central shaft 118 relative to the housing 108. Accordingly, the mounting brackets may substantially maintain a position of the central shaft 118 with respect to the centerline 120.

The fan assembly 116 further includes a hub 122 that is coupled to the central shaft 118. The hub 122 includes a plurality of fan blades 124 that extend radially therefrom relative to the centerline 120. The fan blades 124 extend toward an interior surface 125 of the channel 110, such that a radial gap 127 is formed between the fan blades 124 and the interior surface 125. The fan blades 124 may be coupled to the hub 122 using fasteners, such as rivets, bolts, pressure pins, any suitable adhesive, such as bonding glue, a metallurgical process, such as welding or brazing, or the like. However, in other embodiments, the hub 122 and the fan blades 124 may be a single piece component that is integrally formed during manufacture of the flow generating device 100. In any case, each of the fan blades 124 includes an angled profile or curvature, which facilitates generation of an air flow through the channel 110 during operation of the flow generating device 100.

Figure 7:
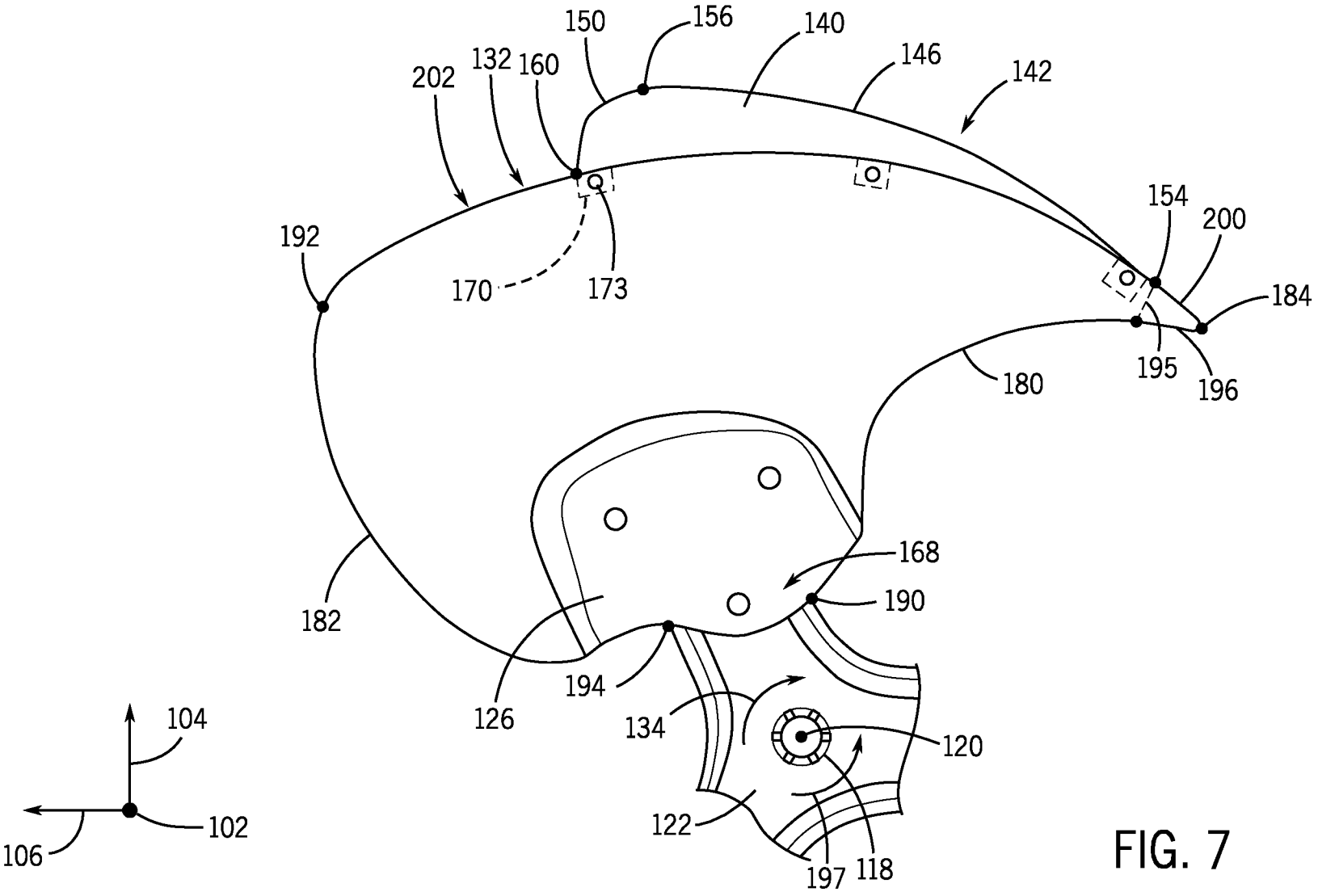
FIG. 7 is a plan view of an embodiment of the winglet coupled to a fan blade of the flow generating device of FIG. 5, in accordance with an aspect of the present disclosure.

For example, as described in greater detail herein, each of the fan blades 124 includes a pressure surface 126, which is shown in FIG. 7, that is oriented toward an intended direction of air flow through the channel 110, and a suction surface 128 disposed opposite the pressure surface 126. The pressure surface 126 may engage with air surrounding the fan assembly 114 while the fan assembly 114 rotates about the centerline 120, such that the pressure surface 126 may direct the air through the channel 110 of the flow generating device 100. For example, in some embodiments, the actuator may be configured to rotate the fan assembly 114 counterclockwise about the centerline 120, as shown by arrow 130, to cause the fan blades 124 to generate an air flow through the channel 110 along the flow path 112 from an upstream end portion 136 of the housing 108 to a downstream end portion 138 of the housing 108. In other embodiments, the actuator is configured to rotate clockwise about the centerline 120 and, thus, direct the air flow in a direction 139 along the axis 102. In such embodiments, the suction surfaces 128 of the blades shown in the illustrated embodiment would be pressure surfaces of the fan blades 124, and, similarly, the pressure surfaces 126 would be suction surfaces.

As noted above, operation of the flow generating device 100 may generate a region of high pressure air proximate the downstream end portion 138 and a region of low pressure air proximate the upstream end portion 136. In other words, an air pressure near the downstream end portion 138 of the housing 108 may be greater than an air pressure near the upstream end portion 136 of the housing 108. This pressure differential may generate a secondary air flow, or a backflow of air, which flows through the radial gap 127 from the pressure surface 126 toward the suction surface 128 of the fan blades 124. As such, the backflow of air may flow in the direction 139, which is generally opposite to a direction of the air flow along the flow path 112 that is generated by the fan blades 124. The backflow of air generates vortices near radial edges 132 of the fan blades 124, which may increase a velocity of air flowing across the suction surface 128 and generate an induced drag force on the fan blades 124 that increases a power consumption of the actuator during operation of the flow generating device 100.

Accordingly, embodiments of the flow generating device 100 discussed herein include a winglet 140 that is coupled to each of the fan blades 124 and is configured to reduce or substantially eliminate the backflow of air through the radial gap 127 and around the radial edges 132 of the fan blades 124. As discussed in greater detail herein, the winglet 140 may extend from the pressure surface 126 of the fan blades 124 into the channel 110, such that the winglet 140 extends along a direction of the flow path 112 through the channel 110. In other words, the winglets 140 may extend generally along the longitudinal direction 102. The winglets 140 may thus block undesirable air flow around the radial edge 132 from the pressure surface 126 to the suction surface 128 of the fan blades 124 during operation of the flow generating device 100. As such, the winglets 140 may reduce aerodynamic drag generated while the fan assembly 114 rotates about the centerline 120, and thus, reduce a power consumption of the actuator. In this manner, the winglets 140 may enhance an operational efficiency of the HVAC system that utilizes the flow generating device 100. As described in greater detail herein, in some embodiments, the winglets 140 couple to a portion of the radial edge 132 corresponding to a section of the fan blades 124 protruding axially from the channel 110 along the direction 139. Accordingly, the winglets 140 may reduce a backflow of air, in particular, around the portion of the fan blades 124 axially protruding from the channel 110.

Figure 6:
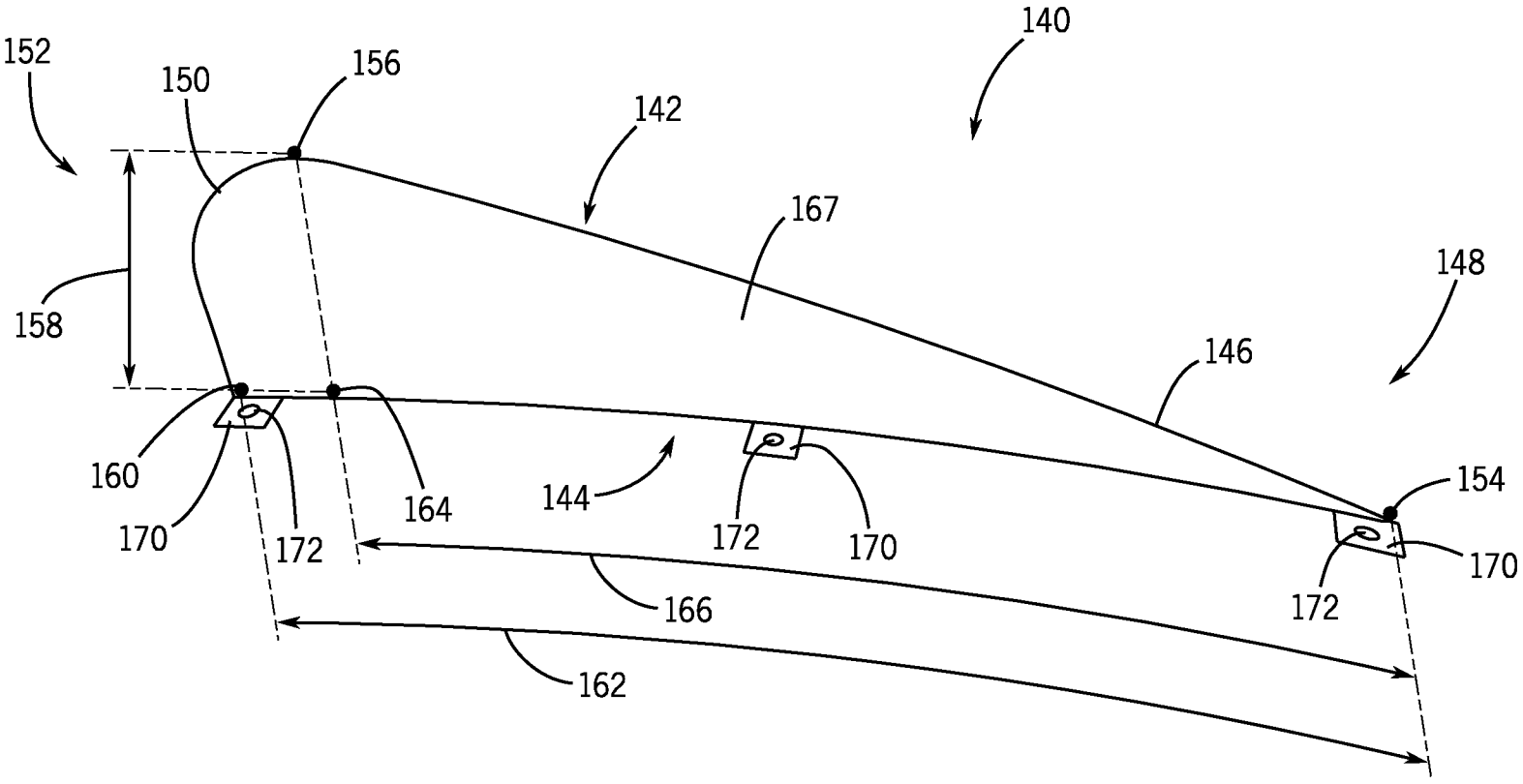
FIG. 6 is a perspective view of an embodiment of a winglet that may couple to the flow generating device of FIG. 5, in accordance with an aspect of the present disclosure.

FIG. 6 is a perspective view of an embodiment of the winglet 140. The winglet 140 includes an upper edge 142, or a leading edge, and a lower edge 144, or a coupling edge, that cooperatively form a perimeter of the winglet 140. As described in greater detail herein, the lower edge 144 may be configured to couple to, or otherwise be positioned proximate to, the pressure surface 126 of one of the fan blades 124 to enable blockage of air flow between the lower edge 144 of the winglet 140 and the pressure surface 126 of the fan blade 124. A portion of the upper edge 142 of the winglet 140 may be a leading edge 146 that is disposed near a first end portion 148 of the winglet 140. Additionally, the winglet 140 includes a trailing edge 150 that is disposed near a second end portion 152 of the winglet 140. Specifically, the leading edge 146 may be defined as a first portion of the upper edge 142 extending between a commencing point 154 of the winglet 140 and an apex 156 of the winglet 140. The apex 156 may be indicative of a point along the upper edge 142 at which a height 158 of the winglet 140 or, in other words, a distance between the upper edge 142 and the lower edge 144, is at a maximum value. Accordingly, the height 158 may be indicative of a total height of the winglet 140 and the upper edge 142. For example, in some embodiments, the height 158 of the winglet 140 at the apex 156 may extend approximately 0.5 centimeters (cm), 1 cm, 2 cm, 3 cm, 4 cm, or more centimeters.

In certain embodiments, a height of the leading edge 146 may increase from substantially zero at the commencing point 154 to the height 158 of the apex 156. For example, in some embodiments, the height of the leading edge 146 may increase linearly from the commencing point 154 to the apex 156. In other embodiments, the height of the leading edge 146 may increase from the commencing point 154 to the apex 156 in an exponential profile, a logarithmic profile, or in any other suitable profile. For example, as described in greater detail herein, the height of the leading edge 146 may increase proportionally to a change in radial thickness of the fan blades 124. It should be noted that in certain embodiments, the commencing point 154 of the leading edge 146 may be disposed at a predetermined height, rather than a height that is substantially zero, such as in the illustrated embodiment of FIG. 6. The trailing edge 150 may be defined as a second portion of the upper edge 142 extending between the apex 156 and a terminating point 160 of the winglet 140. That is, the trailing edge 150 may be disposed posterior to the leading edge 146 relative to a rational direction of the fan blades 124. Similar to the leading edge 146 discussed above, the trailing edge 150 may include any suitable profile that extends between the apex 156 and the terminating point 160.

A distance along the lower edge 144 between the commencing point 154 and the terminating point 160 of the winglet 140 will be referred to herein as a total length 162 of the winglet 140. A position of the apex 156 along the total length 162 may be determined by a projection point 164, which is indicative of a point along the total length 162 at which the apex 156 is positioned. A distance between the commencing point 154 and the projection point 164 will be referred to herein as a leading edge length 166 of the winglet 140. In other words, the total length 162 is indicative of a length of both the leading edge 146 and the trailing edge 150, while the leading edge length 166 is indicative of a length of the leading edge 146 relative to the total length 162. As such, adjusting a magnitude of the leading edge length 166 and adjusting a magnitude of the height 158 of the apex 156 will adjust a profile of the winglet 140. In some embodiments, the leading edge length 166 may be 50%, 60%, 70%, 80%, or more than 80% of the total length 162, while the height 158 of the apex 156 may be 20%, 30%, 40%, 50%, or more than 50% of the total length 162. In other embodiments, the leading edge length 166 may be 0% or 100% of the total length 162. In such embodiments, the winglet 140 may include a generally triangular profile, rather than a generally teardrop profile as shown in the illustrative embodiment of FIG. 6. In yet further embodiments, the winglet 140 may include, for example, a rectangular profile, or any other suitable geometric profile.

Figure 9:
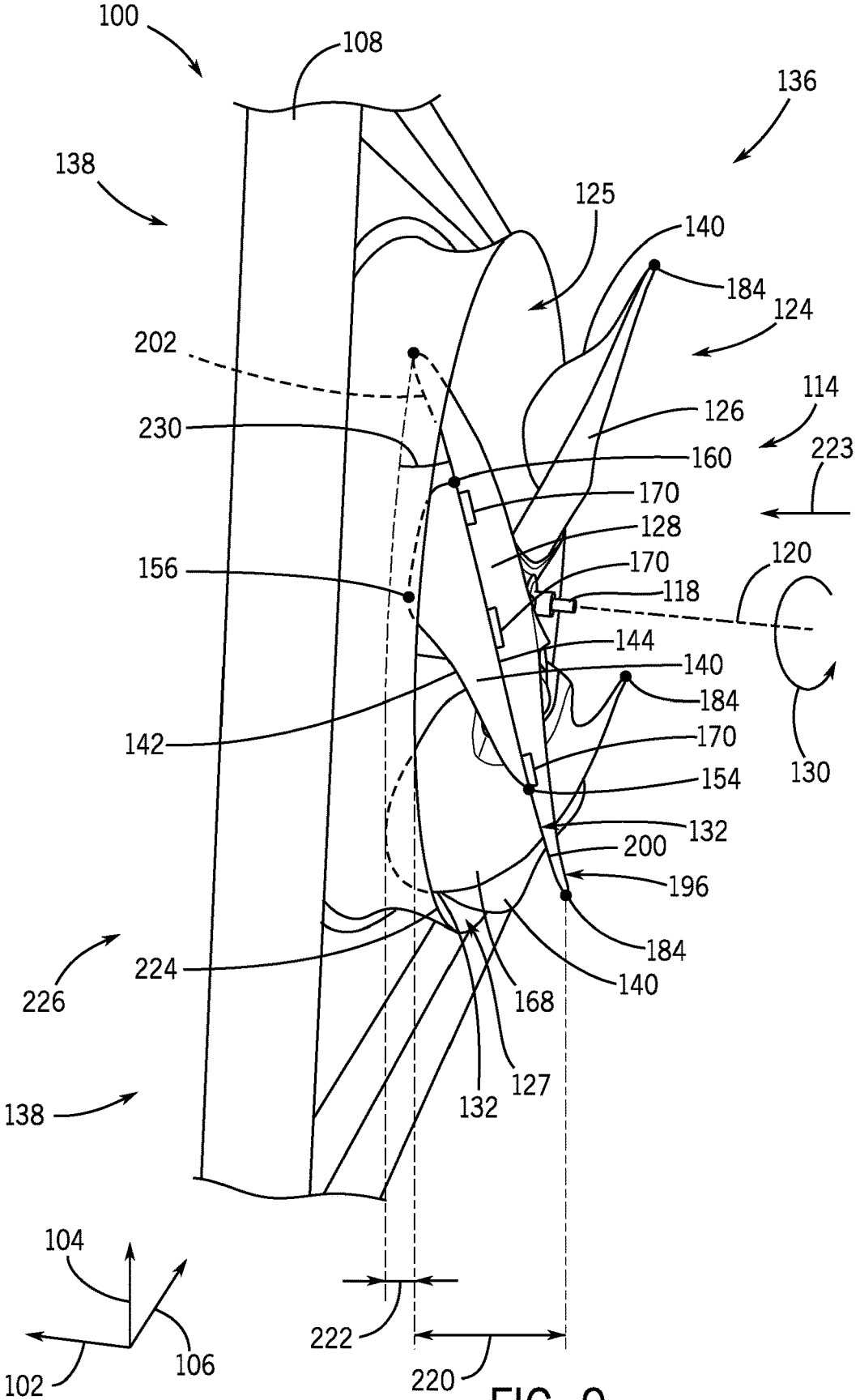
FIG. 9 is a perspective view of an embodiment of the flow generating device of FIG. 5, in accordance with an aspect of the present disclosure.

As shown in the illustrated embodiment of FIG. 6, the winglet 140 may include one or more mounting tabs 170 that extend substantially crosswise from an interior surface 167 of the winglet 140. In other embodiments, the mounting tabs 170 may form any suitable angle with the interior surface 167 of the winglet 140. The mounting tabs 170 enable the winglet 140 to couple to a respective fan blade 168, as shown in FIG. 7, of the fan blades 124. Accordingly, the winglet 140 may bracket a portion of the fan blade 168. For example, each of the mounting tabs 170 may include an aperture 172 that is configured to concentrically align with a respective aperture 173, as shown in FIG. 7, extending through, or into, the fan blade 168. Accordingly, fasteners such as bolts, rivets, friction pins, or the like may be disposed within the apertures 172, 173 to couple the mounting tabs 170 to the fan blade 168. In other embodiments, the mounting tabs 170 may be coupled to the fan blade 124 using an adhesive, such as bonding glue, spot welds, or other fastening process. In such embodiments, the aperture 172 may be omitted from the mounting tabs 170, such that an adhesive may engage with a full surface area of the mounting tabs 170 to couple the mounting tabs 170 to the fan blade 168. In any case, the mounting tabs 170 may be disposed either on the pressure surface 126 of the fan blade 168 or on the suction surface 128, as shown in FIG. 9, of the fan blade 168.

In other embodiments, the mounting tabs 170 may be omitted from the winglet 140, such that the lower edge 144 of the winglet 140 may couple directly to the fan blade 168. For example, the lower edge 144 of the winglet 140 may be coupled to the fan blade 168 using a suitable fastening process or material such as, for example, a weld or bonding glue. It should be noted that the winglet 140 may be constructed of sheet metal, aluminum, fiberglass, polymeric materials, or any other suitable material. In some embodiments, the winglet 140 may be constructed of a same material as the fan blade 168. For example, the fan blade 168 and the winglet 140 may each be constructed of sheet metal. However, in other embodiments, the winglet 140 and the fan blade 168 may each include a different material. In still further embodiments, the winglet 140 may be integral to the fan blade 168, such that the winglet 140 and the fan blade 168 are constructed from a single, continuous piece of material.

Turning now to FIG. 7, each fan blade 168 of the fan blades 124 includes a leading edge 180 that faces a direction of travel or rotation, as shown by arrow 134, of the fan blade 168 and a trailing edge 182. Specifically, the leading edge 180 is defined as extending between a leading tip 184 of the fan blade 168 and a first engagement point 190 of the fan blade 168 and the hub 122. The trailing edge 182 is defined as extending between a trailing tip 192 of the fan blade 168 and a second engagement point 194 between the fan blade 168 and the hub 122. Accordingly, the radial edge 132 of the fan blade 168 extends between the leading tip 184 and the trailing tip 192. However, it should be noted that in certain embodiments, the radial edge 132 may include a portion or all of the leading edge 180 and/or the trailing edge 182.

Figure 8:
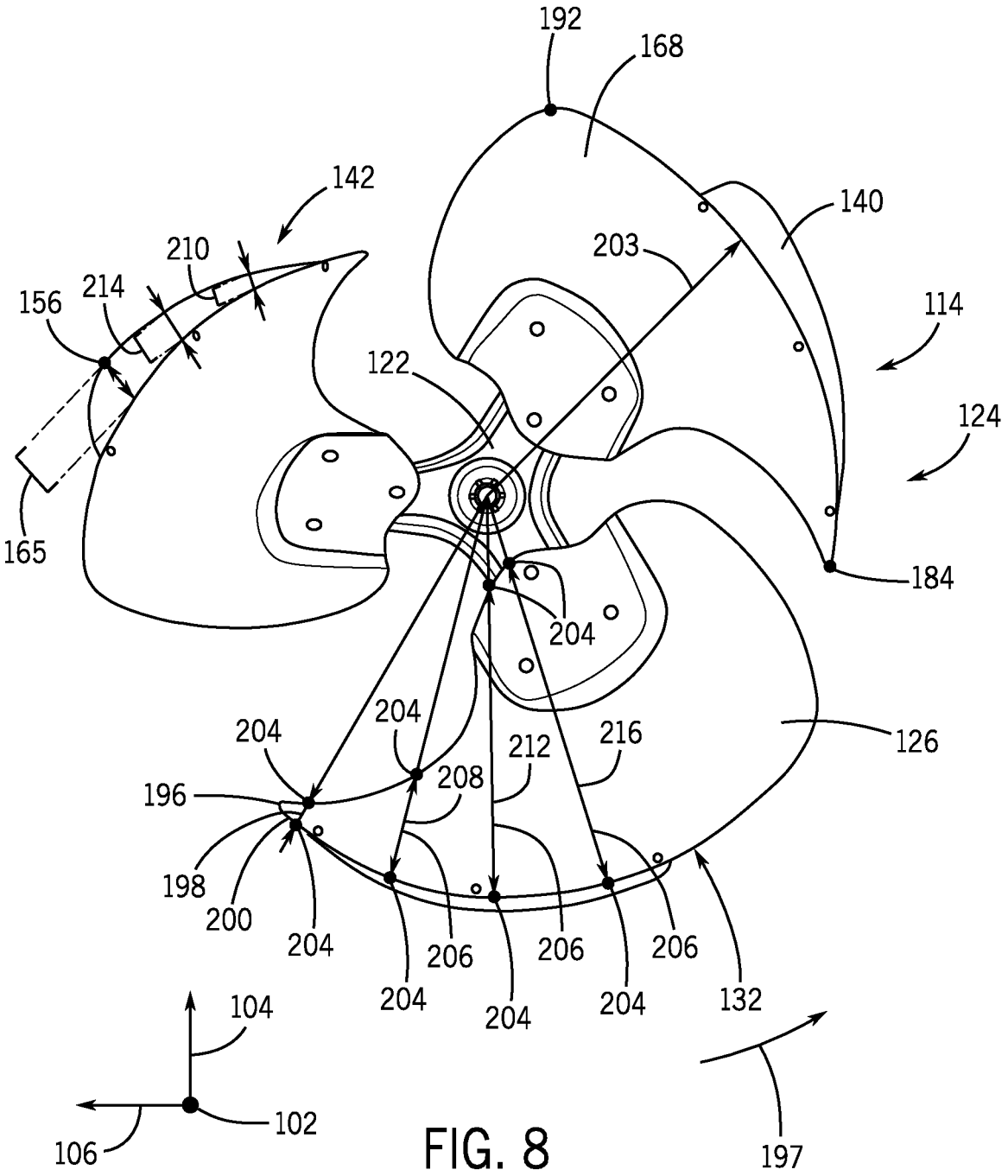
FIG. 8 is a plan view of an embodiment of a fan assembly of the flow generating device of FIG. 5, in accordance with an aspect of the present disclosure.

The fan blade 168 includes a non-uniform profile that extends from the leading edge 180 to the trailing edge 182 of the fan blade 168. For example, the fan blade 168 may include a tip portion 196 disposed near the leading edge 180, which initially engages with the air with respect to rotation of the fan blade 168 about the centerline 120 in the direction indicated by the arrow 134. In the illustrative embodiment of FIG. 7, the tip portion 196 includes a portion of the fan blade 168 disposed between the leading edge 180 and a line 195. In some embodiments, the line 195 extends from the centerline 120 toward the commencing point 154 of the winglet 140. The tip portion 196 thus includes a portion of both the pressure surface 126 and the suction surface 128 of the fan blade 168. As described in greater detail herein, a first radial thickness 198, as shown in FIG. 8, of the tip portion 196 may be relatively small, such that a relatively small surface area of the pressure surface 126 corresponding to the tip portion 196 engages with air during operation of the flow generating device 100. Accordingly, a pressure differential between the pressure surface 126 and the suction surface 128 near the tip portion 196 may be relatively small. As such, this relatively small pressure differential may generate a marginal backflow of air between the pressure surface 126 and the suction surface 128 at the tip portion 196, which may insignificantly affect an operational efficiency of the flow generating device 100. Accordingly, in some embodiments, the commencing point 154 of the winglet 140 may be disposed counter clockwise from the tip portion 196 with respect to the axis 102 and/or the centerline 120 or downstream from the tip portion 196 relative to a direction of travel or rotation of the fan blade 168. Accordingly, the radial edge 132 may include a first open edge 200, or an uncovered edge, which extends along the radial edge 132 from the leading tip 184 to the commencing point 154 in a counter clockwise direction 197. However, it should be noted that in other embodiments, the winglet 140 may be coupled to the tip portion 196 of the fan blade 168. In such embodiments, the commencing point 154 of the winglet 140 may be disposed adjacent to the leading tip 184 of the fan blade 168, such that the radial edge 132 does not include the first open edge 200.

The winglet 140 may be coupled to the fan blade 168 in a position that is counter clockwise to the first open edge 200 along the radial edge 132 and extends along the radial edge 132 toward the trailing tip 192 of the fan blade 168. The winglet 140 may thus block a backflow of air from the pressure surface 126 to the suction surface 128 along the radial edge 132 of the fan blade 168. As discussed in greater detail herein, in some embodiments, the winglet 140 may not extend fully toward the trailing tip 192 of the fan blade 168. In such embodiments, the radial edge 132 of the fan blade 168 includes a second open edge 202 that extends from the terminating point 160 of the winglet 140 to the trailing tip 192 of the fan blade 168 in the counter clockwise direction 197. However, it should be noted that, in other embodiments, the winglet 140 may extend fully to the trailing tip 192 of the fan blade 168, such that the radial edge 132 does not include the secondary open edge 202.

In some embodiments, a radial thickness of the fan blade 168 may increase from the leading edge 180 or along the radial edge 132 in the counter clockwise direction 197. The increasing radial thickness of the fan blade 168 generates a pressure gradient along the pressure surface 126 that increases from the leading edge 180 to the trailing edge 182 as the fan blade 168 rotates about the centerline 120 in the direction 134. For example, the fan blade 168 may compress air from the leading edge 180 toward the trailing edge 182 while the fan blade 168 rotates about the centerline 120 in the direction indicated by the arrow 134. In such embodiments, a tendency of air to backflow around the radial edge 132 increases proportionally to an increase in the pressure gradient along the pressure surface 126 of the fan blade 168. In other words, the tendency of air to backflow around the radial edge 132 increases from the leading tip 184 to the trailing tip 192 of the fan blade 168. As such, a height of the leading edge 146 of the winglet 140 may increase from the commencing point 154 to the apex 156 to account for the variation in air pressure along the radial edge 132 of the fan blade 168.

As shown in FIG. 8, a radial thickness along the fan blade 168 may be indicative of a percentage of a radius 203, or a total radius, of the fan assembly 114, which extends from the centerline 120 toward an outermost point of the fan blades 124. For example, the radial thickness may be defined by a distance between intersection points 204 of the fan blade 168 and respective lines 206 that extend radially from the centerline 120. The tip portion 196 of the fan blade 168 may include a substantially small percentage of the radius 203, referred to herein as the relatively small first radial thickness 198, and thus, generate a marginal backflow of air around the radial edge 132 during rotation of the fan assembly 114. For example, the relatively small first radial thickness 198 may be 5%, 7%, 12%, or 15% of the radius 203. However, in other embodiments, the relatively small first radial thickness 198 may be less than 5% of the radius 203 or greater than 15% of the radius 203. In any case, the winglet 140 may be omitted from a section of the radial edge 132 corresponding to the tip portion 196, referred to herein as the first open edge 200. The fan blade 168 includes a relatively small second radial thickness 208 disposed counter clockwise of the tip portion 196 with respect to the axis 102 or the centerline 120, which may thus correspond to a relatively small second height 210 of the upper edge 142. For example, the relatively small second radial thickness 208 may include 5%, 10%, 15%, 20%, or more than 20% of the radius 203. Accordingly, the winglet 140 may substantially block a backflow of air near this section of the fan blade 168. Similarly, a relatively medium third radial thickness 212 of the fan blade 168 may correspond with a relatively medium third height 214 of the upper edge 142. In some embodiments, the relatively medium third radial thickness 212 may include 40%, 50%, 60%, 70%, or more than 70% of the radius 203. A relatively large fourth radial thickness 216 of the fan blade 168 may be indicative of a section of the radial edge 132 at which a tendency of the air to backflow is greatest. For example, the relatively large fourth radial thickness 216 may be 60%, 70%, 80%, 90%, or more than 90% of the radius 203. Accordingly, the apex 156 of the winglet 140 may be radially aligned with the relatively large fourth radial thickness 216 of the fan blade 168. The height 158 of the apex 156 may be sufficient to block substantially all backflow of air near the relatively large fourth radial thickness 216 of the fan blade 168. As such, a height of the winglet 140 may gradually increase along the winglet 140 based on the increase in radial thickness of the fan blade 168, such that the height of the winglet 140 increases proportional to an increase in the pressure gradient on the pressure surface 126.

Turning now to FIG. 9, as noted above, the fan blades 124 may each include a first section 220, or an exposed portion, which protrudes axially from the channel 110 relative to the longitudinal axis 102 and a second section 222 that extends into the channel 110. In other words, the fan assembly 114 is disposed partially within the channel 110, such that the first section 220 of the fan blades 124 is disposed upstream of an end portion 224 of the channel 110 relative to a direction 223 of fluid flow through the channel 110. For clarity, the direction 223 of fluid flow may be along the flow path 112 from the upstream end portion 136 of the housing 108 to the downstream end portion 138 of the housing 108. Conversely, the second section 222 of the fan blades 124 is disposed downstream of the end portion 224 of the channel 110 relative to the direction 223 of fluid flow through the channel 110. The end portion 224 of the channel 110 may be indicative of an upstream end portion of the channel 110, which may be axially aligned with the upstream end portion 136 of the housing 108. Similarly, a downstream end portion 226 of the channel 110 may be axially aligned with the downstream end portion 138 of the housing 108.

In some embodiments, the second open edge 202 of the radial edge 132 may correspond to the second section 222 of the fan blades 124. In other words, the second open edge 202 may be disposed downstream of the end portion 224 of the channel 110, and thus, within the channel 110. The radial gap 127 between the interior surface 125 of the channel 110 and the second open edge 202 of the fan blades 124 may be relatively small, and thus, substantially mitigate air flow through the radial gap 127 from the pressure surface 126 to the suction surface 128 of the fan blades 124. Accordingly, the winglet 140 may not be coupled to the second open edge 202 of the fan blades 124, as noted above, because the housing 108 may substantially block a backflow of air along the second section 222 of the fan blades 124.

The winglets 140 may couple to a portion of the radial edge 132 corresponding to the first section 220 of the fan blades 124. In other words, the winglets 140 are coupled to a portion of the fan blades 124 that is disposed upstream of the end portion 224 of the channel 110 relative to the direction 223 of the fluid flow through the channel 110. Specifically, the terminating point 160 of each of the winglets 140 may be disposed adjacent to, or upstream of the end portion 224 of the channel 110. Accordingly, the winglets 140 substantially block the backflow of air around a portion of the radial edge 132 corresponding to the first section 220 of the fan blades 124 or, in other words, a portion of the radial edge 132 that is disposed upstream of the end portion 224 of the channel 110. It should be noted that, in certain embodiments, the winglet 140 may be coupled to a portion of the radial edge 132 that is disposed within the channel 110 or, in other words, the winglet 140 may be disposed along a portion or all of the second section 222 of the fan blades 124. In some embodiments, the first section 220 of the fan blades 124 may include 50%, 60%, 70%, 80%, or more than 80% of a total surface area of the pressure surface 126 of the fan blades 124, the suction surface 128 of the fan blades 124, or both. However, in other embodiments, the first section 220 of the fan blades 124 may include less than 50% of a total surface area of the fan blades 124.

In some embodiments, a blade angle 230 of the fan blades 124 with respect to the axis 104 may enable a portion of the winglet 140 to axially protrude downstream of the end portion 224 and into the channel 110 even while the winglet 140 is coupled to the first section 220 of the fan blades 124 that is disposed upstream of the end portion 224. For example, in some embodiments, the height 158 of the apex 156 may enable the apex 156 of the winglet 140 to extend within at least a portion of the channel 110 due to the orientation of the winglets 140 via the blade angle 230. In such embodiments, the terminating point 160 of the winglet 140 is disposed upstream of the end portion 224 of the channel 110, such that the lower edge 144 of the winglet 140 does not extend into the channel 110. In some cases, the apex 156 of the winglet 140 may thus facilitate blocking the backflow of air along a transitioning point that is disposed between the first section 220 of the fan blades 124 and the second section 222 of the fan blades 124.

Technical effects of the winglet 140 may include a reduction in induced drag on the fan blades 124 during operation of the flow generating device 100. For example, the winglet 140 may block, or substantially mitigate the formation of drag inducing vortices near the radial edge 132 of the fan blades 124. Accordingly, the winglet 140 may enhance an operation efficiency of the flow generating device 100, and thus, enhance an operational efficiency of an HVAC system utilizing the flow generating device 100.

As discussed above, the aforementioned embodiments of the flow generating device 100 may be used on the HVAC unit 12, the residential heating and cooling system 50, or in any other suitable HVAC system. However it should be noted that the specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A flow generating device for a heating, ventilation, and/or air conditioning system, comprising:

a housing having a channel defining a flow path of a fluid;

a fan blade having a rotational axis extending through the channel, wherein the fan blade is configured to rotate to force the fluid along the flow path in a downstream direction aligned with the rotational axis, wherein a portion of the fan blade axially protrudes beyond the channel in an upstream direction extending opposite the downstream direction; and a winglet extending from a radial edge of the portion of the fan blade and in the downstream direction, wherein the radial edge comprises an open edge that extends from a leading tip of the fan blade to a commencing point of the winglet on the fan blade, wherein the winglet does not extend from the open edge, and wherein the winglet comprises an apex positioned downstream of an inlet of the channel.

2. The flow generating device of claim 1, wherein the winglet extends generally parallel to a flow direction of the fluid.

3. The flow generating device of claim 1, wherein the winglet is coupled to the portion of the fan blade.

4. The flow generating device of claim 3, wherein the winglet comprises a plurality of mounting tabs engaged with the fan blade to couple the winglet to the fan blade.

5. The flow generating device of claim 4, wherein the fan blade comprises a pressure surface facing toward the downstream direction and a suction surface opposite the pressure surface, and wherein the plurality of mounting tabs is disposed on the suction surface.

6. The flow generating device of claim 1, wherein a surface area of the portion of the fan blade protruding axially beyond the channel comprises at least 60 percent of a total surface area of a suction surface of the fan blade.

7. The flow generating device of claim 1, wherein the winglet comprises a leading edge facing a rotational direction of the fan blade and a trailing edge disposed posterior to the leading edge relative to the rotational direction of the fan blade, wherein the leading edge and the trailing edge adjoin at the apex, and wherein the apex defines a total height of the winglet.

8. The flow generating device of claim 7, wherein the total height is between 20% and 50% of a total length of the winglet.

9. The flow generating device of claim 7, wherein a length of the leading edge comprises at least 80 percent of a total length of the winglet.

10. The flow generating device of claim 7, wherein the leading edge extends between the commencing point of the winglet and the apex, wherein a height of the leading edge increases from the commencing point to the apex proportionally to a change in radial thickness of the fan blade.

11. The flow generating device of claim 1, wherein the winglet extends from the commencing point located on the radial edge of the portion of the fan blade and terminates at a terminating point located on the radial edge of the portion of the fan blade.

12. The flow generating device of claim 11, wherein the apex is aligned with a projection point located along the radial edge and between the commencing point and the terminating point.

13. The flow generating device of claim 1, wherein an additional portion of the fan blade is disposed within the channel, wherein the additional portion of the fan blade comprises an additional radial edge, wherein the additional radial edge comprises an additional open edge, and wherein the winglet does not extend from the additional open edge.

14. A flow generating device for a heating, ventilation, and/or air conditioning (HVAC) system, comprising:

a housing having a channel defining a flow path of a fluid;

a plurality of fan blades disposed partially within the channel, wherein the plurality of fan blades is configured to rotate about an axis within the channel and direct the fluid along the flow path in a downstream direction aligned with the axis; and a winglet coupled to a portion of a fan blade of the plurality of fan blades, wherein the portion of the fan blade axially protrudes beyond the channel in an upstream direction extending opposite the downstream direction, wherein the winglet extends from a radial edge of the portion of the fan blade in the downstream direction, wherein the radial edge comprises an open edge that extends from a leading tip of the fan blade to a commencing point of the winglet on the fan blade, wherein the winglet is offset from the open edge along the radial edge, and wherein the winglet comprises an apex positioned downstream of an inlet of the channel.

15. The flow generating device of claim 14, wherein a surface area of the portion of the fan blade axially protruding beyond the channel comprises 60 percent of a total surface area of a suction surface of the fan blade, and wherein an additional portion of the fan blade is disposed within the channel.

16. The flow generating device of claim 14, wherein the winglet comprises a leading edge facing a direction of travel of the fan blade, wherein the leading edge extends from the commencing point of the winglet to the apex of the winglet, and wherein a height of the leading edge increases proportionally to a change in radial thickness of the fan blade from the commencing point to the apex.

17. The flow generating device of claim 16, wherein the apex comprises a total height of the winglet and is radially aligned with a section of the fan blade that comprises more than 90 percent of a total radius of the fan blade.

18. A flow generating device for a heating, ventilation, and/or air conditioning (HVAC) system, comprising:

a housing having a channel defining a flow path for a fluid flow, wherein an end portion of the channel is configured to receive the fluid flow from an ambient environment;

a fan blade disposed partially within the channel and configured to rotate about an axis within the channel, wherein rotation of the fan blade facilitates the fluid flow through the channel in a downstream direction aligned with the axis, and wherein a portion of the fan blade axially protrudes beyond the end portion of the channel in an upstream direction extending opposite the downstream direction; and a winglet bracketing at least a section of the portion of the fan blade and extending from a radial edge of the portion of the fan blade in the downstream direction, wherein the radial edge comprises an open edge that extends from a leading tip of the fan blade to a commencing point of the winglet on the fan blade, wherein the winglet does not extend from the open edge, and wherein the winglet includes an apex positioned downstream of the end portion of the channel.

19. The flow generating device of claim 18, wherein a surface area of the portion of the fan blade axially protruding beyond the channel comprises 60 percent of a total surface area of a suction surface of the fan blade.

20. The flow generating device of claim 18, wherein the winglet comprises a plurality of mounting tabs protruding substantially crosswise to an interior surface of the winglet, and wherein the plurality of mounting tabs is coupled to a suction surface of the fan blade.

21. The flow generating device of claim 18, wherein the winglet is constructed of sheet metal, aluminum, fiber glass, or polymeric materials.

22. The flow generating device of claim 18, wherein the winglet extends generally parallel to the downstream direction.

* * * * *